US006283608B1

(12) United States Patent
Straat

(10) Patent No.: US 6,283,608 B1
(45) **Date of Patent: *Sep. 4, 2001**

(54) LIGHT FIXTURE FOR SHELVING

(76) Inventor: Patricia Ann Straat, 830 Windy Knoll, Skyeville, MD (US) 21784

( * ) Notice: Subject to any disclaimer, the term of this patent is extended or adjusted under 35 U.S.C. 154(b) by 0 days.

This patent is subject to a terminal disclaimer.

(21) Appl. No.: 09/306,129

(22) Filed: May 6, 1999

Related U.S. Application Data

(63) Continuation-in-part of application No. 08/808,399, filed on Feb. 28, 1997, now Pat. No. 5,915,824.

(51) Int. Cl.[7] ..... F21V 33/00
(52) U.S. Cl. ..... 362/133; 362/127; 312/223.5
(58) Field of Search ..... 362/125, 127, 362/132, 133, 285, 432; 312/223.5

(56) References Cited

U.S. PATENT DOCUMENTS 2,157,264 5/1939 Kirby ..... 362/133
2,749,430 6/1956 Cohn ..... 362/432
4,689,726 8/1987 Kretzschmar ..... 362/127
5,034,861 7/1991 Sklenak et al. ..... 362/92

*Primary Examiner*—Laura K. Tso
(74) *Attorney, Agent, or Firm*—Robert T. Braun

(57) ABSTRACT

A display assembly having at least one shelf. The back edge of the shelf being permanently affixed to a light support member. The light support member extends above and below the shelf. The light support member is spaced away from a support surface to provide an air gap between the light support member and the support surface. A light is attached to the light support member such that it is positioned within the air gap. Thereby the light provides backlighting. The light may be attached to the light support member by way of a bracket. The bracket can be positioned by way of mounting straps. The bracket may be J shaped, U shaped, rectangular shaped or any other suitable shape for producing substantially bidirectional light. The shelf can be either fixed or removable.

23 Claims, 6 Drawing Sheets

LIGHT FIXTURE FOR SHELVING

CROSS-REFERENCE TO RELATED APPLICATIONS

This application is a Continuation-In-Part of application Ser. No. 08/808,399 filed on Feb. 28, 1997, now U.S. Pat. No. 5,915,824.

BACKGROUND OF THE INVENTION

1. Field of the Invention

This invention relates in general to light fixtures, and in particular, to light fixtures associated with shelving. More specifically, but without restriction to the particular embodiments hereinafter described in accordance with the best mode of practice, this invention relates to both a quick-release light fixture that casts multi-directional light from behind an opaque shelf and a fixed light fixture that casts multi-directional light from behind a shelf.

2. Discussion of the Related Art

In the modern world, humankind has increasingly populated his environment. As the population has grown, the space for each individual has decreased. As each individual office and home space has become smaller, so has the furniture that is used in those spaces. One particular kind of furnishing which has decreased in size includes display shelves, book shelves, and china cabinets. In the past, book shelves and china cabinets were very large pieces of furniture that were not illuminated by light. As workspace, office space, and home living space had a higher premium placed thereon, these china cabinets have become smaller and more decorative in nature. As they became more decorative in nature, the china cabinets, display shelves, entertainment centers, bookshelves, and other display units began to include lighting so that people could better see the things displayed on the shelves. In particular, china cabinets and display shelves are lit so that people may easily view the china, knick-knacks, and books thereon. Additionally, lights and lighting in display units, china cabinets, display shelves, and the like are used to create atmosphere or ambience.

In the past, there have been many ways of putting lighting on shelves. One of the ways was merely to place a lamp on the shelf. This had the disadvantages of being easily knocked off the shelf and of taking a large amount of shelf space. As time went on, lights were developed that were fastened fixedly to the shelves of the display units, china cabinets, entertainment centers, and display shelves. The light in prior display units, china cabinets, entertainment centers, and display shelves was usually uni-directional. Some shelving in some prior display units provide light which is bi-directional. This bi-directional lighting was accomplished primarily through the use of transparent surfaces such as glass.

Prior methods of shelf lighting include light bulbs that are exceedingly hard to change as the lights were fixed to the shelf or display unit. Usually the user would be required to empty out all the books, knick-knacks, or china being displayed to ensure that he would not knock over and damage such items while changing the light bulb. A further limitation in prior display units includes problems in illuminating opaque shelves. The lighting of opaque shelving is typically uni-directional. Even in units that have bi-directional lighting through transparent surfaces, a way to easily change light bulbs has not previously hereto been provided. In addition to the above limitations, prior illuminated display units had unattractive electric power cords that were frequently in view of the user. Thus, prior to this invention, there has not been disclosed any convenient way to provide bi-directional lighting with light bulbs being easily changed for opaque shelving while hiding from view unattractive electric power cords. In addition thereto, prior to this invention, bi-directional lighting for opaque shelves was not known.

OBJECTS AND SUMMARY OF THE INVENTION

It is, therefore, an object of the present invention to improve illuminated shelves.

Another object of this invention is to enable a user to easily change a light bulb attached to the shelf of a display unit.

It is a further object of the present invention to provide a shelving unit with a light assembly which is easily removable for changing the light.

Another object of this invention is to provide a removable light source that provides bi-directional light for shelves while fastened to walls or display units.

A further object of the present invention is to provide bi-directional light to an opaque shelf.

It is the further object of the present invention to provide a readily detachable light fixture that also prevents items from falling off the shelf.

Yet a further object of the present invention is to provide a bi-directional light source that also prevents objects from falling off the shelf.

Still another object of the present invention is to provide a removable bi-directional light source with a hidden electric supply cord.

It is yet a further object of the present invention to provide a removable bi-directional light assembly wherein the light is amplified by a reflective bracket.

It is still yet a further object of the present invention to provide a bi-directional light wherein the light is amplified by a reflective bracket.

A still further object of the present invention is to provide bi-directional light to an opaque shelf by way of an air-gap.

An additional object of the present invention is to provide a removable light source by means of an air gap between a wall and the removable light source holder attached to the shelving.

Yet a further object of the present invention is to provide a removable light source wherein the light source is held to a removable member engaged with the shelving unit by an easily attached bracket.

An additional object of the present invention is to provide a removable light member or assembly by use of an air gap between a wall and a fixed light assembly holder attached to the shelving.

Yet a further object of the present invention is to provide bi-directional light by way of an air-gap by using an easily attached bracket. These and other objects according to the present invention may be attained by providing at least one shelf for mounting to a support surface which includes a top and bottom surface and a front and back edge, at least one support member for attaching the shelf to the support surface, a light support member affixed to the back edge of the shelf, the light support member extending above and below the shelf and being spaced away from the support surface to create an air gap there between, and a light attached to the light support member which provides back-lighting.

The display assembly may further include a light holding bracket for mounting the light, the light holding bracket being secured to the light support member. In conjunction with this aspect of the present invention the light holding bracket is secured to the light support member by at least one strap. The at least one strap may be loosened to allow precise positioning of the light holding bracket along a longitudinal centerline of the light support member. The shelf in this embodiment of the invention may be fixed to the support surface or alternatively removable.

According to yet another embodiment of the present invention, there is provided a display unit including a frame having a back and supporting sides, at least one shelf having a front edge and a back edge. The back edge of the shelf is spaced away from the back of the frame to provide an airgap therebetween. A light support member is affixed to the back edge of the shelf. The light support member extends above and below the shelf. The light is attached to the light support member.

In accordance with one aspect of this embodiment of the present invention, a light is positioned within the airgap to provide backlighting. Further according to this embodiment of the present invention, a light holding bracket is provided for mounting the light. The light holding bracket is secured to the light support member and may be secured to the light support member by at least one strap. This at least one strap may be preferably loosened to allow precision positioning of the light holding bracket along longitudinal centerline of the light support member.

In accordance with yet another aspect of this embodiment of the present invention, the light holding bracket preferably has a long side having an inner and an outer surface, an a short side having an inside and an outside surface, the outer surface having insulation attached thereon to reduce heat transfer from the light to the light support member.

In still yet another embodiment of the present invention a light fixture is provided having a light source, and a bracket for holding the light source, the light source being positioned within the bracket to provide substantially bi-directional light. According to another aspect of this invention, the bracket includes a long side having an inner surface and an outer surface and a short side having an inside surface and an outside surface, the outer surface having insulation attached thereon to reduce heat transfer. The inside surface of the bracket may also have insulation attached thereon to further reduce heat transfer from the light.

In accordance with another aspect of the present invention the insulation on the inside surface of the bracket may have reflective material placed thereon. In accordance with still yet another embodiment of the present invention the bracket can be made of reflective nonconductive material thereby removing the need for the insulation layers and the reflective layer.

According to still yet another aspect of the present invention, the bracket has a long side having an inner surface and an outer surface and a short side having a inside surface and an outside surface, the outer surface has insulation attached thereon to reduce heat transfer from the light, the inner surface has insulation placed thereon to further reduce heat transfer, and the insulation on the inner surface has a reflective layer placed upon it.

In one aspect of the present invention, the light fixture is used in conjunction with a light support member which is spaced from a back surface to create an airgap therebetween. The bracket is attached to the light support member and positioned within the airgap to provide backlighting.

According to still yet another embodiments of the invention, the bracket can be alternatively rectangular, J-shaped, or U-shaped.

There is also provided an illuminated display shelf for mounting to a support surface which includes at least one shelf having a top and a bottom surface and a front and a back edge, at least one support member for attaching the shelf to the support surface, a removable light support member releasably engaged with the back edge of the shelf, the light support member being spaced away from the surface to provide an air-gap therebetween, and a light attached to the light support member.

According to one aspect of this invention, the removable light support member is releasably engaged with the back edge by hook and loop fastener material or alternatively, the removable light support member has a front face containing a groove for snugly engaging the back edge of the shelf.

The illuminated display shelf according to the present invention may further include a light holding bracket for mounting the light, the light holding bracket being secured to the removable light support member. In conjunction with this aspect of the present invention, the light holding bracket is secured to the removable light support member by at least one strap. The at least one strap may be loosened to allow precise positioning of the light holding bracket along a longitudinal centerline of the removable light support member. The shelf in this embodiment of the invention may be fixed to the support surface or alternatively removable from the support surface.

According to another aspect of this invention, the light holding bracket has a long side having an inner and outer surface and a short side having an inside and outside surface. The outer surface may have an insulation attached thereon to reduce heat transfer from the light to the light support member. In this embodiment, the inside surface may have insulation affixed thereon and may preferably include reflective material placed on the inside surface. The light holding bracket may be made of a non-conductive material, a reflective material, or a reflective non-conductive material.

According to another embodiment of the present invention, there is provided a display unit including a frame having a back and a supporting sides, at least one shelf having a front and a back edge, the back edge of the shelf being spaced away from the back to provide a gap therebetween, a removable light support member releasably engaged with the back edge of the shelf, the removable light support member being releasable from the shelf through the gap, and a light attached to the light support member.

In accordance with one aspect of this embodiment of the present invention, a light holding bracket for mounting the light is provided. The light holding bracket is secured to the removable light support member, and may be secured to the removable light support member by at least one strap. This at least one strap may be preferably loosened to allow precise positioning of the light holding bracket along a longitudinal center line of the removable light support member.

According to another aspect of this embodiment of the present invention, the light support member may include a longitudinal bore for containing an electric supply cord extending from the light. The longitudinal bore thereby hides the electric supply cord from view. The removable light support member may be releasably engaged with the back edge by hook and loop fastener material or alternatively the removable light support member may have a front face containing a groove for snugly engaging the back edge of the shelf wherein the removable light support member is releasably engaged with the back edge by a dadoed groove running the length of the removable light support member.

In accordance with yet another aspect of this embodiment of the present invention the light holding bracket preferably has a long side having an inner and outer surface, and a short side having an inside and outside surface, the outer surface having an insulation attached thereon to reduce heat transfer from the light to the light support member. The inside surface may also have insulation affixed thereon, and the insulation on the inside surface may preferably have a reflective material affixed thereon. The light holding bracket according to this aspect of the present embodiment may be made of a non-conductive material, or a reflective material, or alternatively a reflective non-conductive material.

According to still another aspect of this invention, there is provided a method for illuminating a display shelf which includes the steps of providing at least one shelf having a top and a bottom surface and a front and a back edge, attaching the shelf to a support surface by at least one support member, engaging a removable light support member with the back edge of the shelf so that the light support member is quickly releasable from the back edge, the light support member being spaced away from the surface to provide an air-gap therebetween, and positioning a light on the light support member so that when the light support member is engaged with the back edge of the shelf, light is directed into the air-gap and above and below the shelf.

BRIEF DESCRIPTION OF THE DRAWING

Further objects of the present invention together with additional features contributing thereto and advantages accruing therefrom will be apparent from the following description of the preferred embodiments of the invention which is shown in the accompanying drawing, wherein.

DETAILED DESCRIPTION OF A PREFERRED EMBODIMENT

Figure 1:
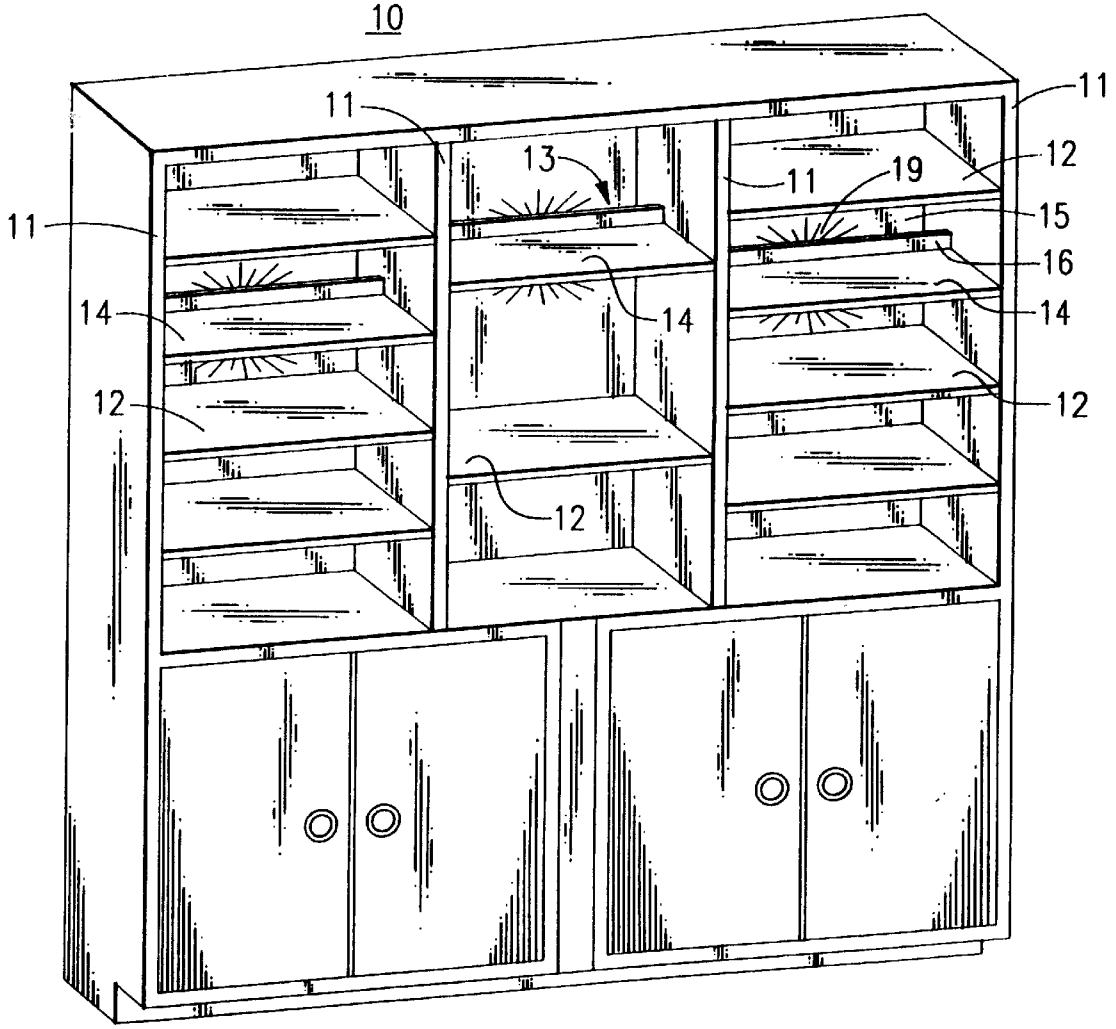
FIG. 1 is a perspective view of a shelving unit incorporating various aspects of the present invention.

Referring now to FIG. 1, there is shown a shelving unit 10 in accordance with the present invention. The shelving unit 10 contains several shelves 12 and three shortened shelves 14. The shortened shelf 14 has an air-gap 13 between its back edge 22, FIG. 2, and a rear wall 15 of the shelving unit 10. On the back edge 22 of the shortened shelf 14 there is a light support member 16 (FIG. 3) for holding a light assembly containing light 18, FIGS. 4A, 9, and 12. The light 18 provides bi-directional light 19 to the air-gap 13 and the normal shelf 12 as well as bi-directional light 19 above and below the shortened shelf 14. Through reflection and diffusion, bi-directional light 19 is also provided to the shortened shelf 14. Bi-directional as used herein, is meant to include light directed substantially upwardly and downwardly relative to shortened shelf 14 and light support member 16. The primary effect of the bi-directional light 19 is to backlight the shortened shelf 14 and any objects placed thereon.

Figure 5:
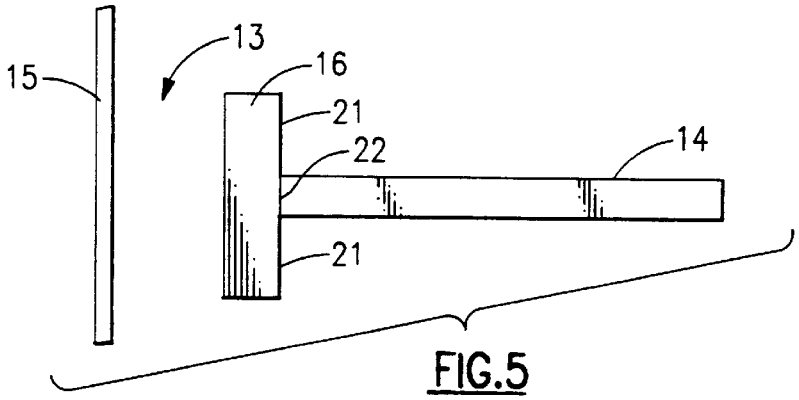
FIG. 5 is a side view of an alternative embodiment of a shelf and alternative support member according to the present invention.

In one embodiment of the present invention, as best shown in FIG. 5, the light support member 16 may be permanently affixed, by glue, nails, screws or other means, to the back edge 22 of the shortened shelf 14. Similarly, the shortened shelf 14 can be removable or permanently affixed to the shelving unit 10. A front face 21 of the light support member 16 extends above and below shortened shelf 14. By extending the front face 21 above and below the shortened shelf 14 several desirable results are achieved. A first desirable result is that substantially bi-directional or diffused light 19 from the light 18 is provided within the air-gap 13. Some light within the air-gap 13 shines above and below the shortened shelf 14, as shown in FIG. 1. Some light shining within the air-gap 13 is provided to the shortened shelf 14 through diffusion and reflection off the rearwall 15, as illustrated in FIGS. 1 and 5. The light within the shelving unit 10 from the light 18 on the light support member 16 affixed to the shortened shelf 14 creates a unique backlighting effect both within the shelving unit 10 and at the rear of the shortened shelf 14. Different backlighting effects may be obtained by use of different types and intensities of a variety of light bulbs implemented as the light 18. Such light bulbs include halogen, warm or cool spotlights, incandescent light bulbs, or colored light.

A second desirable result is that the front face 21 of the light support member 16 which extends above the shortened shelf 14 prevents objects placed on top of shortened shelf 14 from being pushed off the shortened shelf 14 and falling into the air-gap 13.

Figure 7:
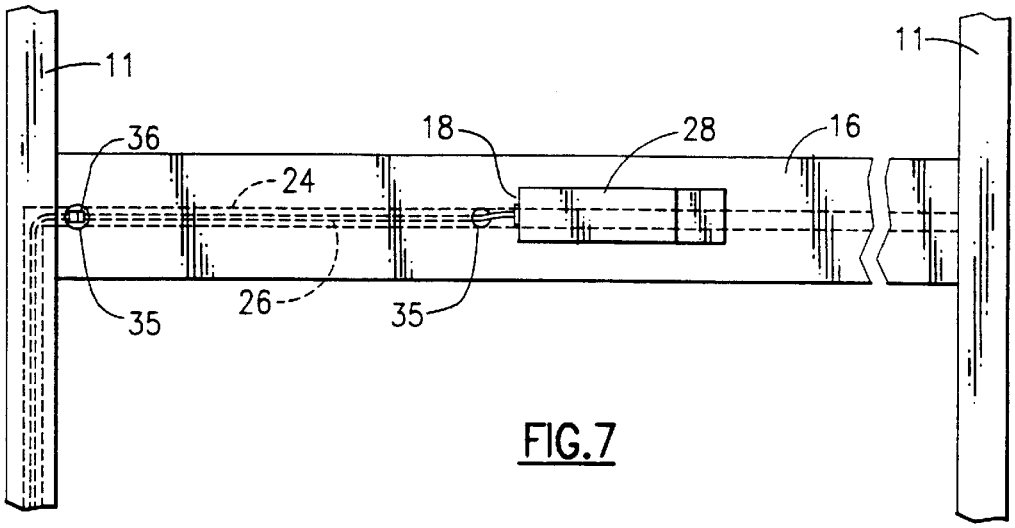
FIG. 7 is a rear elevation of a shelving unit showing the light bracket and cord assembly in accordance with the present invention.
Figure 8:
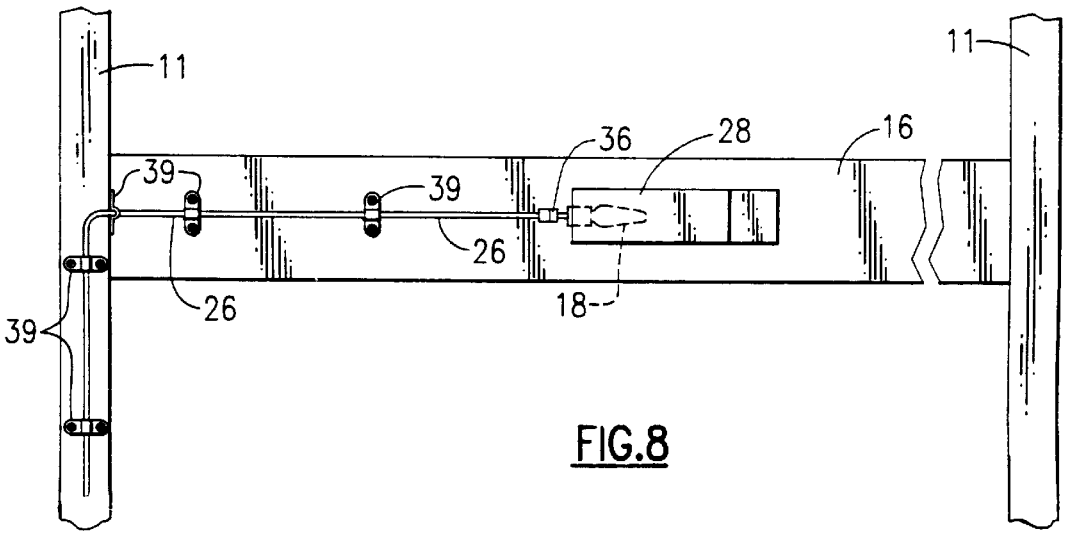
FIG. 8 is a view similar to FIG. 7 showing an alternative embodiment for connecting the electric cord to the light.

A third desirable result is that an electric cord 26, FIGS. 4A, 7, 8, and 9, for supplying electric power to the light 18 can easily be hidden by the light support member 16. In this embodiment, the light support member 16 is preferably opaque. The electric cord 26 can remain hidden by several methods including running along the back of the light support member 16 to one of the vertical supports in the shelving unit 10, or by exiting the rear wall 15 perpendicular or approximately perpendicular to the light support member 16 and attaching to the light 18 as shown in FIGS. 7 and 8 or 4A and 9, respectively. In the display unit 10, the electric cord 26 can run along the back of both the light support member 16 and one of the vertical sides 11 of the display unit 10, as shown in FIG. 8.

Alternatively the shortened shelf 14 can be removable from the shelving unit 10. In this alternative embodiment, the light support member 16 holding the light 18 is affixed to the back edge 22 of the shortened shelf 14. The entire shortened shelf 14 with the affixed light support member 16 can be easily removed from within the display unit 10, FIG. 1, or from mounting bracket(s) 32, FIG. 9 discussed in detail later. By having the entire shortened shelf 14 with affixed light support member 16 removable, a user is able to quickly change the light 18. To remove the shortened shelf 14 with affixed light support member 16 a user would first clear the shortened shelf 14 of any objects placed thereon. The user would uncouple an electric coupling 36, see FIG. 4B and 6–9, freeing the shortened shelf 14 with affixed light support member 16 to be lifted from the display unit 10 or the mounting brackets 32. According to a different aspect of the invention, the electric cord 26 could be pulled from the display unit 10 as the shortened shelf 14 with affixed light support member 16 is removed and then retracted into the display unit 10 when the shortened shelf 14 is replaced, thereby eliminating the need for electric coupling 36, FIG. 8. The electric coupling 36 could also be placed on or built into light holding bracket 28 at the rear of light 18. Once the shortened shelf 14 having affixed light support member 16 holding the light 18 is lifted clear of the display unit 10 or the mounting bracket(s) 32, the user can easily change the light 18 and replace the shortened shelf 14 with light support member 16 within the display unit 10 or on the mounting bracket(s) 32 and recouple the electric coupling 36 thereby restoring power to light 18.

Figure 2:
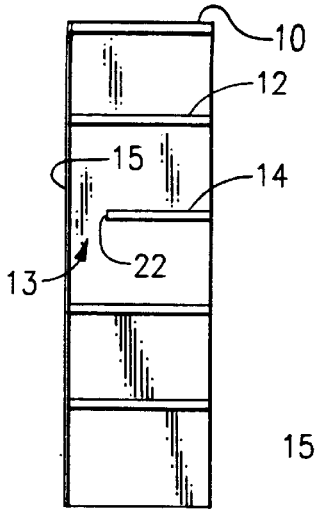
FIG. 2 is a side elevation of the upper portion of the shelving unit having a shelf according to the teachings of the present invention.

Turning now to FIG. 2, there is shown an upper portion of the shelving unit 10 including several shelves 12 and the shortened shelf 14. The shelves 12 shown in comparison with the shortened shelf 14 having the air-gap 13 between the back edge 22 of the shortened shelf 14 and the rear wall 15. The air-gap 13 is an important aspect of this invention because air-gap 13 allows the light support member 16, FIGS. 1, 3, 4A and 4B, to be easily disengaged for a change of the light 18, FIGS. 4B and 12. Further, the air-gap 13 allows the light 18 to provide bi-directional light 19 above and below the shortened shelf 14. Also, the air gap 13 allows dissipation of heat from light 18.

Figure 3:
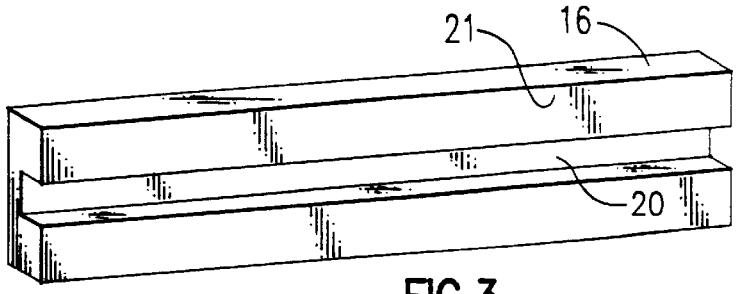
FIG. 3 is perspective view of a light support member in accordance with one aspect of the present invention.

Turning now to FIG. 3, there is shown the light support member 16. The light support member 16 has a groove 20 running the length of the front face 21, so that the light support member 16 can be snugly engaged with, or alternatively be permanently secured to, the back edge 22 of shortened shelf 14, as illustrated in FIGS. 2 and 4A.

Figure 4A:
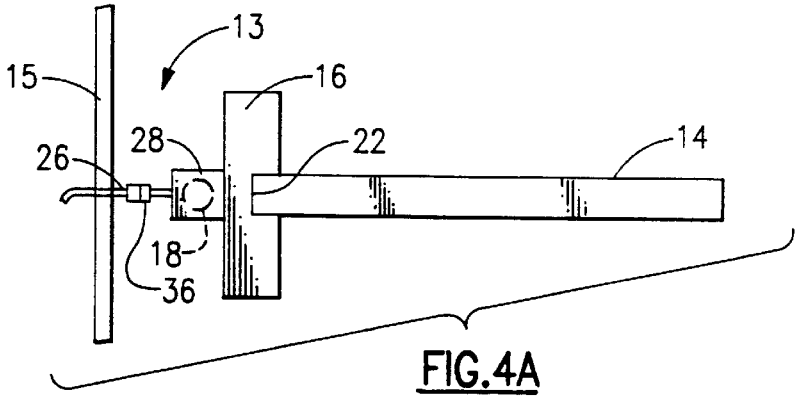
FIG. 4A is a side view of a shelf showing the light support member of FIG. 3 with attached light assembly in conjunction therewith.
Figure 4B:
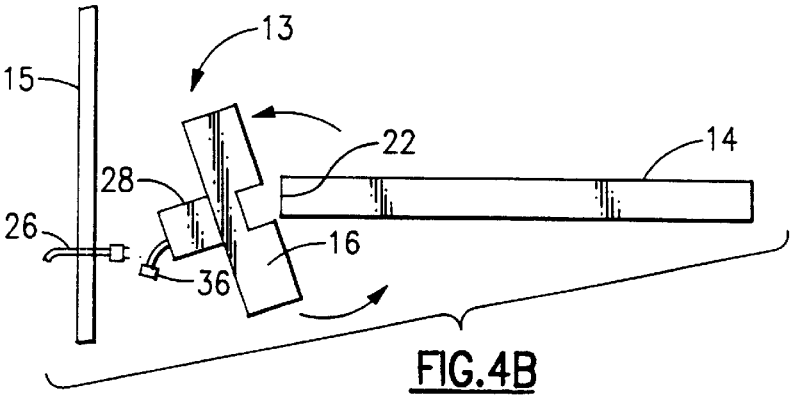
FIG. 4B is a view similar to 4A showing removal of the light support member according to one embodiment of the present invention.

FIG. 4A shows the shortened shelf 14 and the light support member 16 with the air-gap 13 between the shortened shelf 14 and the rear wall 15. The light support member 16 is provided with a light holding bracket 28 containing the light 18, FIG. 12, which is provided with electrical power by the electric cord 26 having an electric coupling 36. The light holding bracket 28 can be permanently affixed to the light support member 16, by nails, screws, glue and other fastening means, or may be removeably secured by straps and other means discussed later. It can be seen that the light support member 16 is engaged with the back edge 22 of the shortened shelf 14. In the removable embodiment of the light support member 16, the fit between the light support member 16 and the back edge 22 of the shortened shelf 14 is preferably such that there is enough clearance to remove the light support member 16, but not enough slippage that the light support 16 could fall off easily. In one preferred embodiment for the removable light support member 16, the air-gap 13 is dimensioned such that accidental rotation of the light support member 16 will cause the light support member 16 to tip against the rear wall 15, thereby preventing the light support member 16 from dropping through the air-gap 13. In addition, in another preferred embodiment, FIG. 1, the tolerance between the length of the light support member 16 and sides 11 is such that the light support member 16 is supported by adjacent sides 11 when accidentally disengaged from the back edge 22 of the shortened shelf 14. The appropriate clearance between the groove 20 and the shortened shelf 14 provides a snug fit between the light support member 16 and the shortened shelf 14 so that they may be easily disassembled from each other by unplugging the electric coupling 36 and disengaging the light support member 16 from the back edge 22 of the shortened shelf 14 as shown in FIG. 4B. The snug fit thus plays a role in protecting items displayed beneath the shortened shelf 14. In this preferred embodiment, the light support member 16 is a piece wood having a dadoed groove 20 in the front face 21 that snugly fits with the back edge 22 of the shortened shelf 14. In the fixed embodiment of the light support member 16, the back edge 22 of the shortened shelf 14 can be permanently secured or affixed to the light support member 16 by use of glue in the groove 20. Alternately screws, nails, glue, or other fastening means may be used to permanently secure the shortened shelf 14 to light support member 16.

Figure 10:
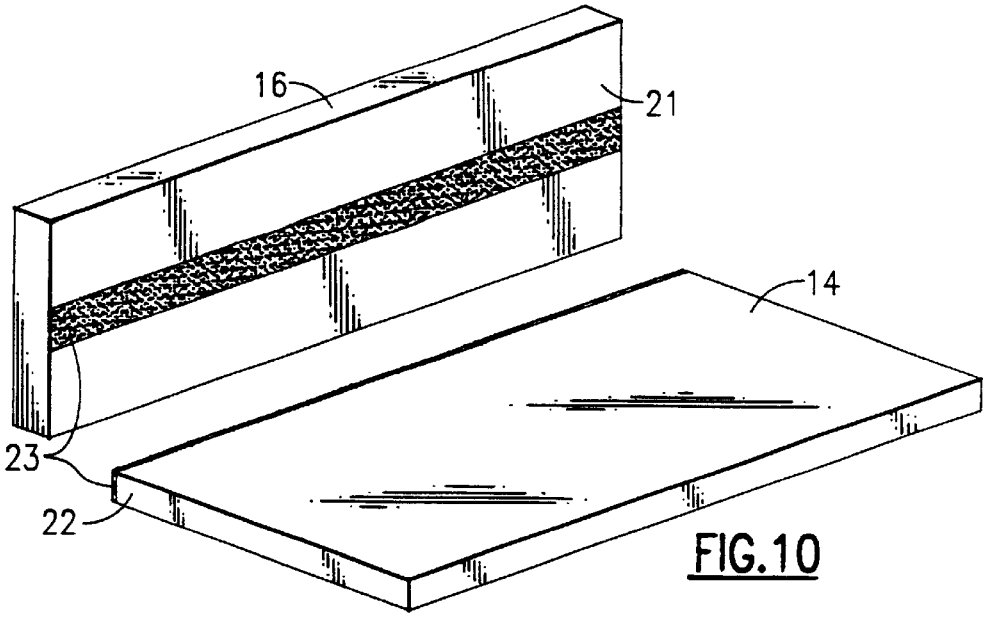
FIG. 10 is a perspective view of the shelf and light support member including a hook and loop fastener connection in accordance with one embodiment of the present invention.

In further regard to the removable embodiment of the light support member 16, it should be appreciated with reference to FIGS. 4A, 4B and 10 that a hook and loop fastener 23 like (VELCROθ) could be placed in the groove 20 and on the back edge 22 of the shortened shelf 14. This has the additional benefit that the groove 20 does not have to be as precisely manufactured as it would if there were no hook and loop fastener in the groove 20 and on the back edge 22 of the shortened shelf 14. Lastly, it can be seen that both the affixed and the removable light support member 16 when engaged with the back edge 22 of the shortened shelf 14 has the added benefit of preventing objects displayed on the shortened shelf 14 from falling off the shortened shelf 14 into the air-gap 13 between the back of the light support member 16 and real wall 15.

FIG. 4B shows the shortened shelf 14 with the light support member 16 in the air-gap 13 between the back edge 22 of shortened shelf 14 and the rear wall 15. FIG. 4B further shows that the electric cord 26 is readily unplugged at the electric coupling 36 to remove the light support member 16 from the back edge 22 of the short shelf 14. It can be seen that the light support member 16 has been disengaged from the back edge 22 of the shortened shelf 14. The light support member 16 can easily be disengaged into the air-gap 13 by the user wishing to change the light 18, thereby allowing easy change of the light 18.

Referring now to FIG. 10, an alternative embodiment of the shortened shelf 14 and the removable embodiment of the light support member 16 is shown. It can be seen that having a hook and loop fastener 23 on the back edge 22 of the shortened shelf 14 and a hook and loop fastener 23 in the middle of the front face 21 of the light support member 16 eliminates the need for the groove 20, thereby removing a manufacturing step.

Figure 6:
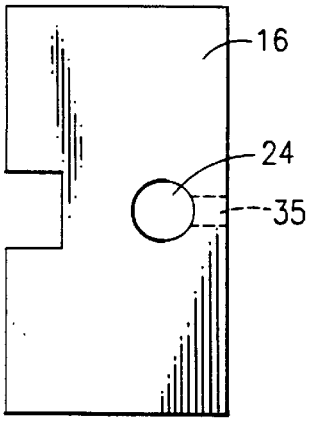
FIG. 6 is a side view of the light support member showing the hideaway tunnel for hiding an electric cord according to the present invention.

Now turning to FIGS. 6 and 7, there is shown the light support member 16 having a tunnel 24 which is a blind bore that extends a predetermined length along the light support member 16 terminating in exit openings 35 for carrying the electric cord 26 to the light 18 for supplying power and hiding the electric cord 26 within the tunnel 24. Alternatively, tunnel 24 may extend through the entire length of light support member 16. The tunnel 24 is formed by drilling the bore into one end of the light support member 16 down its length to a predetermined depth. Each exit opening 35 in the light support member 16 is formed by drilling a perpendicular hole through the back of the light support member 16 into the exit tunnel 24. The tunnel 24 is preferably formed along the longitudinal centerline of light support member 16. The tunnel 24 has the additional benefit of hiding the electric cord 26 from view. As shown in FIG. 7, the shortened shelf 14 with the light support member 16 is supported between the two sides 11 of the shelving unit 10. The tunnel 24 in the light support member 16 contains the electric cord 26 which is attached through the exit opening 35 to the light 18 at one end, and attached to the electric coupling 36, within the exit opening 35 at the other end, and continues through another exit opening 35 in the side 11 of the shelving unit 10 as shown in FIG. 7. It should be noted that the exit opening 35 in light support member 16 is of sufficient size to allow the electric coupling 36 to be coupled and uncoupled by hand. The electric coupling 36 is located near the side 11 so that the light support member 16 can be easily disengaged from the back edge 22 of the shortened shelf 14 by unplugging the electric coupling 36. In the fixed embodiment of the light support member 16, however, the electric coupling 36 is not required.

FIG. 8 shows an alternative embodiment of the fixed embodiment of the light support member 16 for connecting the electric cord 26 to the light 18. The electric cord 26 runs along the back of the side 11 and the back of the light support member 16 to the light 18 and is attached to the light 18 at electric coupling 36. The electric cord 26 is held by several eyehooks 39 placed along the back of side 11 and the light support member 16. This embodiment has the advantage that the tunnel 24 does not have to be blind bored into the light support member 16 or the side 11 and eliminates the need for the two exit openings 35 in the light support member 16 and the exit opening 35 in the side 11. In the removable embodiment of the light support member 16, the electric cord 26 may contain the electric coupling 36 positioned near side 11 to allow the easy removal and replacement of the light support member 16. It should be appreciated that the hook 39 does not have to be an eyehook. It could alternatively be a J-hook or any other suitable means capable of supporting the electrical cord 26. Similarly, in the embodiment for connecting the electric cord 26 in conjunction with the fixed embodiment of the light support member 16 used in conjunction with the fixed embodiment of the shortened shelf 14, the electric coupling 36 is not required as the electric cord 26 can be hard wired to the light 18.

Figure 9:
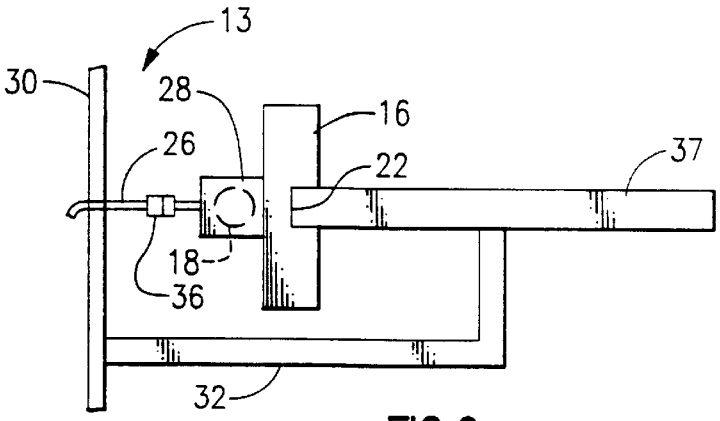
FIG. 9 shows an alternative embodiment for supporting a display shelf according to the present invention.

FIG. 9 shows an alternative embodiment, which includes a display shelf 37 having the back edge 22. In this embodiment, the light support member 16 may be either permanently secured to the display shelf 37 or alternatively removable therefrom. The display shelf 37 is mounted to a surface 30 such as a wall. The display shelf 37 is mounted to the surface 30 by the mounting bracket(s) 32. It can be seen that the back edge 22 of the display shelf 37 is engaged with the light support member 16 which in turn has the light 18 mounted thereon. The light 18 is supplied power through the electric cord 26 which extends substantially perpendicularly from surface 30 directly behind the light holding bracket 28 and the light support member 16 thereby hiding the electric cord 26 from view. The length of the light support member 16 can be modified to be shorter or longer than the length of the display shelf 37 so that the light support member 16 engages only a portion of the back edge 22 or all of the back edge 22, respectively, of the display shelf 37. Modifying the length of the light support member 16 so that it is shorter than the display shelf 37, would allow the light support member 16 or multiple light support members 16 to be easily removable from the back edge 22 of display shelf 37 between two mounting brackets 32. It should be further appreciated when viewing FIG. 7, that the electric cord 26 is hidden from the view of anyone looking at the display shelf 37 by being positioned directly behind light support member 16. The electric cord 26 further contains the electric coupling 36 which is separable so that the light support member 16 may be disengaged from the back edge 22 of the display shelf 37 for easy change of the light 18. Additionally, it should be appreciated from the present disclosure that the electric cord 26 could be fixedly attached to the light 18 by providing a longer length electric cord 26 within surface 30 such that the electric cord 26 would pull out of surface 30 when light support member 16 was disengaged from the back edge 22 of the display shelf 37 for changing the light 18. Further, the electric cord 26 could be retracted back into the surface 30 or pushed back into the surface 30 when the light support member 16 was re-engaged with the back edge 22 of the display shelf 37 after the light 18 was changed. The retractable feature of the electric cord 26 may be implemented by use of a recoiling mechanism mounted behind surface 30 or within shelving unit 10. These modifications to the electric cord 26 may be applied to the embodiment shown in FIGS. 1–8. In both the fixed and removable embodiments of the light support member 16 shown in FIG. 9, the display shelf 37 is provided with the unique backlighting effects of the present invention by the light 18 contained within the light holding bracket 28. Different backlighting effects may be obtained by use of different types and intensities of a variety of light bulbs implemented as the light 18. Such light bulbs, include halogen, warm or cool spotlights, incandescent light bulbs, or colored light.

Figure 11:
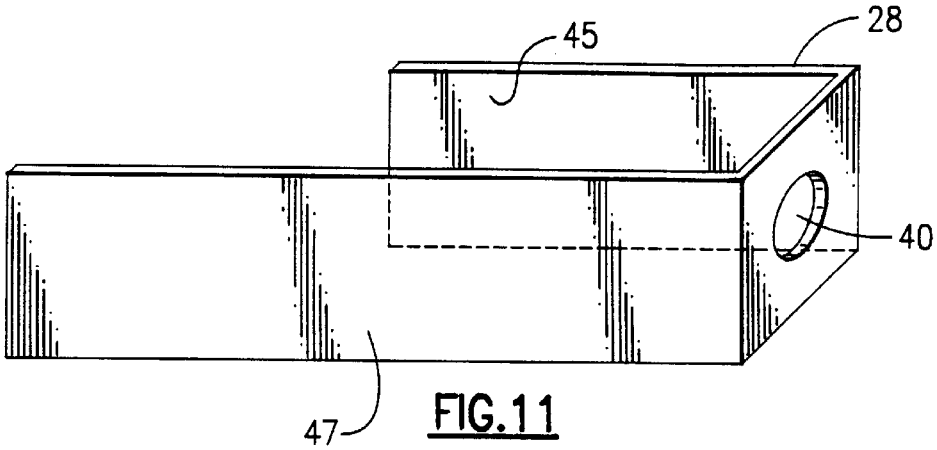
FIG. 11 is a perspective side view of a J-shape light support bracket according to the present invention.
Figure 12:
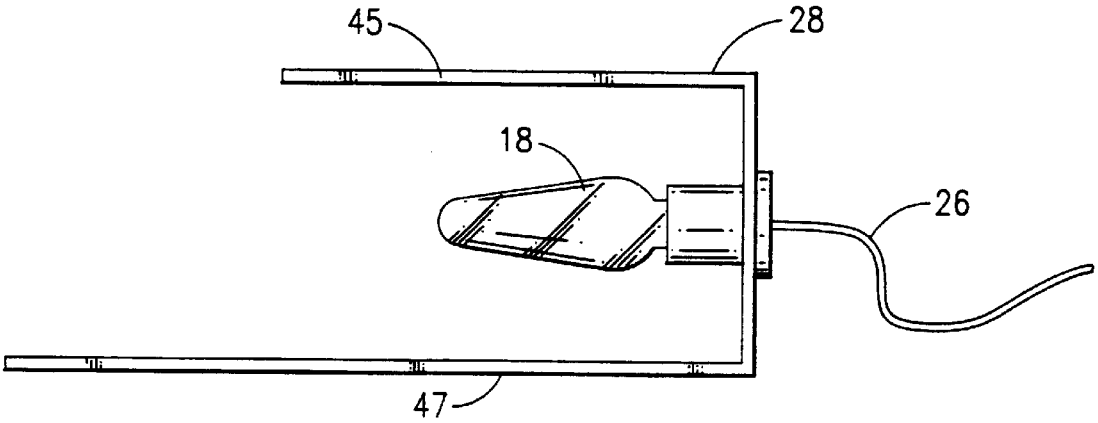
FIG. 12 is a side view of the J-shaped light support bracket of FIG. 11 containing a light source provided therein.

FIGS. 11 and 12 show the light holding bracket 28 containing a hole 40 for receiving the light source 18. The light holding bracket 28 is preferably in a J-shape and made of metal. Alternatively, the light holding bracket 28 may be U-shaped or box-shaped or any other suitable shape that allows light to be directed substantially upwardly and downwardly. The J-shape form of the light holding bracket 28 provides a short leg 45 and a long leg 47. FIG. 12 shows the light holding bracket 28 containing the light 18. The light 18 is placed within the light holding bracket 28 through the hole 40 with the electric cord 26 extending therefrom. The open space between the short and long legs 45 and 47, respectively, allows the light holding bracket 28 to direct light from the light 18 above and below either of the shelves 14 and 37 thereby creating bi-directional light 19 within the shelving unit 10 or in association with the display shelf 37.

Figure 13:
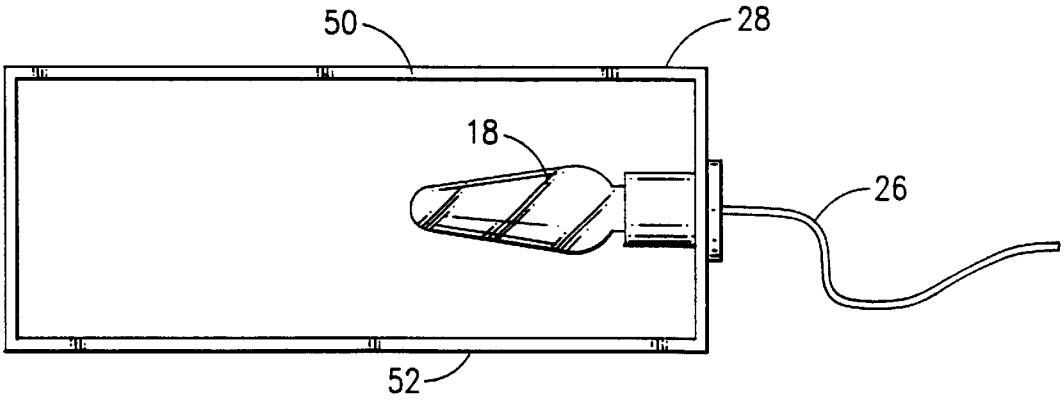
FIG. 13 is a side view of a first alternate embodiment of the light holding bracket according to the present invention.

FIG. 13 shows the light holding bracket 28 having a box shaped form. The light 18 is placed within the light holding bracket 28 through the hole 40 with electric cord 26 extending therefrom. The light 18 illuminates the inside of the light holding bracket 28. The light holding bracket 28 then causes light within the light holding bracket 28 into a substantially vertical plane causing the light to be substantially bi-directional. The bi-directional light 19 is directed above and below, and by diffusion and reflection, either of shelves 14 and 37.

Figure 14:
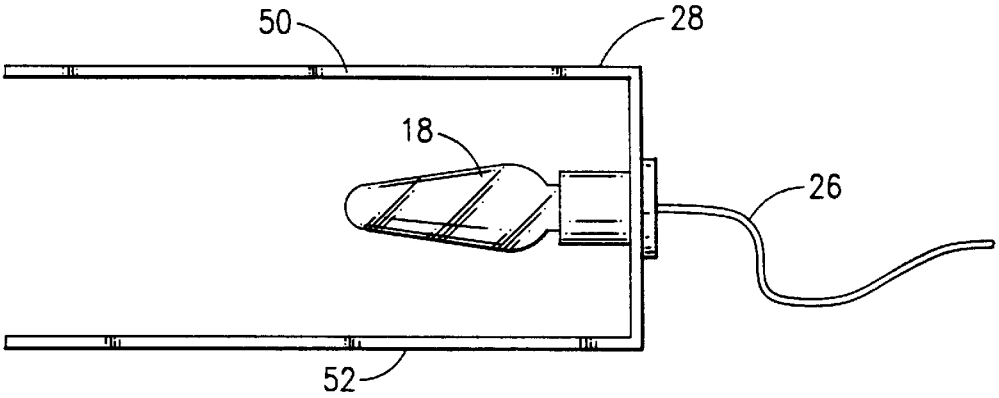
FIG. 14 is a side view of a second alternate embodiment of the light support bracket according to this invention.

FIG. 14 illustrates an alternative embodiment of the light holding bracket 28, which is substantially U-shaped. An upper leg 50 and a lower leg 52 are formed so as to be substantially the same length in both embodiments shown in FIGS. 13 and 14. In the U-shaped embodiment shown in FIG. 14, the light 18 illuminates the inside of the U-shaped light holding bracket 28. The light 18 within the light holding bracket 28 is forced by the legs 50 and 52 into the substantially vertical column causing the light to be substantially bi-directional. In this manner, bi-directional light is thereby directed above and below, and through diffusion and reflection, around shelves the 14 and 37 thereby creating a unique backlighting effect within shelving unit 10 or in association with the display shelf 37. It should be appreciated by viewing FIGS. 13 and 14 that the upper portion 45 of the inside of light holding bracket 28 could have insulation affixed thereon to prevent heat transfer from the light. Insulation may also be placed below lower leg 47 of light holding bracket 28 to prevent heat transfer from the light to the light support member (not shown). An alternative embodiment for the light holding bracket 28 is to fashion the light holding bracket 28 out of suitable non-conductive material thereby eliminating the need for insulation. In addition, the non-conductive material may be reflective or coated with reflective material.

Figure 15:
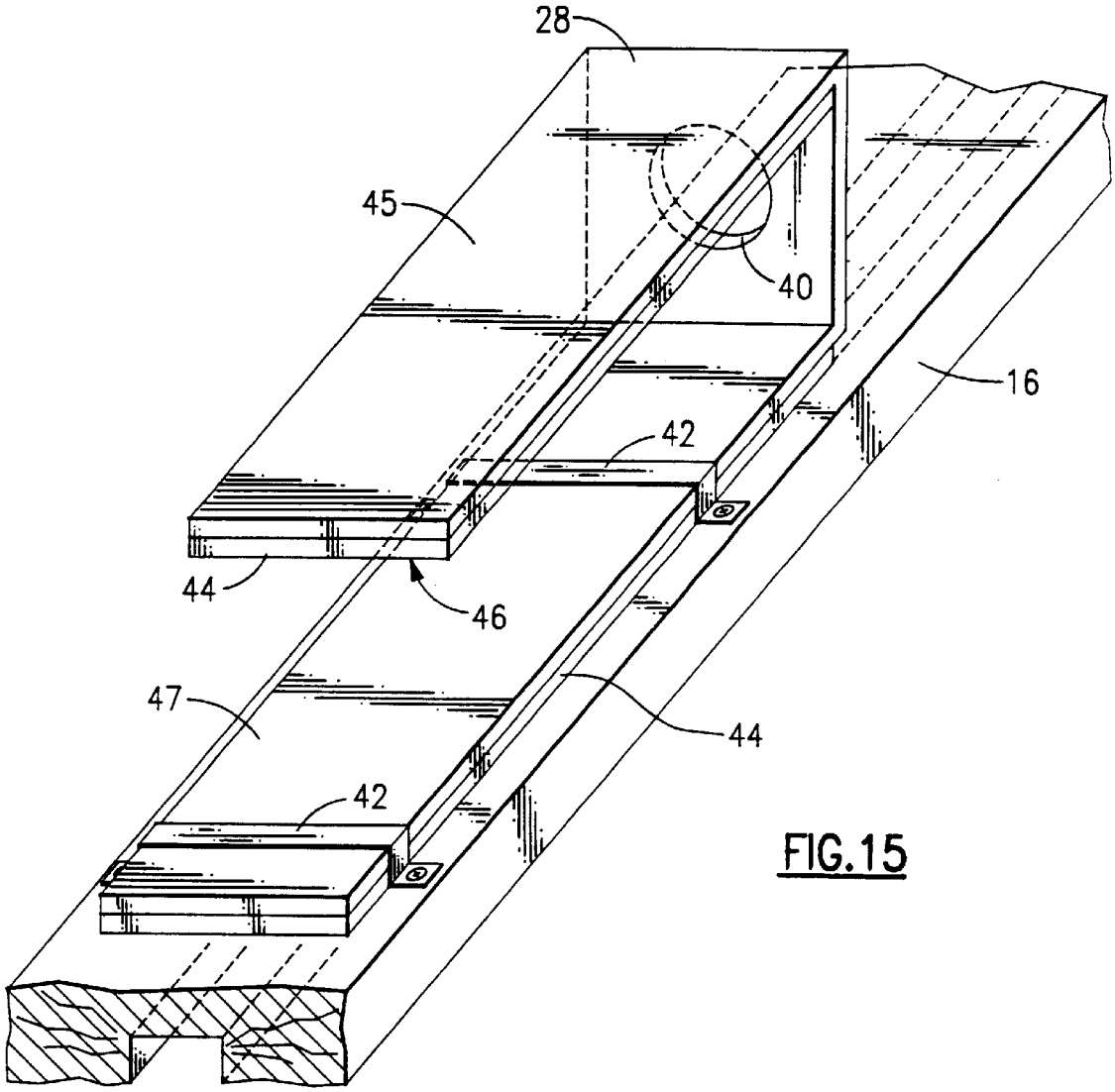
FIG. 15 is a perspective view of the light support bracket of FIG. 11 mounted to the light support member of FIG. 3.

FIG. 15 shows the J-shaped light holding bracket 28 mounted to the light support member 16 by two straps 42—42 across long leg 47. It should be noted that other means such as guides and snaps could be used in place of straps 42—42 to allow the light holding bracket 28 to be precisely positioned and in certain embodiments removed. In one preferred embodiment, the straps 42—42 may be loosened to allow precise positioning of the light holding bracket 28 along the longitudinal centerline of the light support member 16. This allows light to be precisely centered on the light support member 16 relative to the shortened shelf 14 to thereby evenly distribute the light. Alternatively, the straps 42—42 may be sufficiently loose as to allow the light holding bracket 28 to be easily removed and replaced. Being able to remove the light holding bracket 28 with the light 18 allows a user to quickly change the light 18 in the fixed embodiment of the light support member 16. The light holding bracket 28 may be insulated with an insulation 44 placed between the long leg 47 and the light support member 16. The insulation 44 reduces heat transfer between the light 18 from reaching the wooden light support member 16 in the preferred embodiment. The light 18 is preferably 15 watts or less to reduce the amount of heat produced by the light 18. To further prevent heat from the light 18 from heating the display shelf 37, surface 30, or shelving unit 10, further insulation 44 may be placed on the short leg 45 of the light holding bracket 28. Furthermore, the short leg 45 of the light holding bracket 28 may contain a reflective layer 46 for providing greater bi-directional illumination from the light 18. In the preferred embodiment, the reflective layer 46 is tin foil. However, it should be appreciated that the entire light holding bracket 28 may be fashioned from a reflective material thereby eliminating the need for a reflective layer. It should also be appreciated that the upper insulation 44 on the short leg 45 of the light holding bracket 28 could also be made of reflective material, thereby eliminating the need for a reflective layer. An alternative embodiment for the light holding bracket 28 is to fashion the light holding bracket 28 out of suitable non-conductive material thereby eliminating the need for insulation. In addition, the non-conductive material may be reflective or coated with reflective material. It should be noted that the J shaped for m of the light holding bracket 28 may be attached to the light support member 16 in the reverse of the way shown in FIG. 15. That is, short let 45 could be attached to light support member 16 and long leg 47 would then be held above and parallel to the short leg 45.

It should be appreciated by viewing FIGS. 13 and 14 that the upper portion 45 of the inside of light holding bracket 28 could have insulation affixed thereon to prevent heat transfer from the light. Insulation may also be placed below lower leg 47 of light holding bracket 28 to prevent heat transfer from the light to the light support member (not shown). An alternative embodiment for the light holding bracket 28 is to fashion the light holding bracket 28 out of suitable non-conductive material thereby eliminating the need for insulation. In addition, the non-conductive material may be reflective or coated with reflective material.

While this invention has been described in detail with reference to certain preferred embodiments, it should be appreciated that the present invention is not limited to those precise embodiments. Rather, in view of the present disclosure, which describes the current best mode for practicing the invention, many modifications and variations would present themselves to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

What is claimed is:

1. A display assembly, comprising:

at lease one shelf having a top and a bottom surface and a front and a backedge;

at least one support member for attaching said at least one shelf to a support surface;

a light support member affixed to said back edge of said shelf, said light support member extending above and below said shelf, and spaced away from said support surface to provide an air-gap there between; and a light attached to said light support member, said light providing backlighting.

2. The display assembly according to claim 1 further including a light holding bracket for mounting said light.

3. The display assembly according to claim 1 further including a light holding bracket for mounting said light, said light holding bracket being secured to said light support member by at least one strap.

4. The display assembly according to claim 1 further including:

a light holding bracket for mounting said light; and at least one strap mounted on said light support member for securing said light holding bracket thereto, said at least one strap being adjustable to allow precise positioning of said light holding bracket along said light support member.

5. The display assembly according to claim 1 wherein said at least one shelf is fixed to said support surface.

6. The display assembly according to claim 1 wherein said at least one shelf is removable from said support surface.

7. A display unit, comprising:

a frame having a back and at least two supporting sides;

at least one shelf having a front edge and a back edge, said back edge of said shelf being spaced away from said back of said frame to provide an air-gap therebetween;

a light support member affixed to said back edge of said shelf, said light support member extending above and below said shelf; and a light attached to said light support member.

8. The display unit according to claim 7 wherein said light is positioned within said air gap to backlighting.

9. The display unit according to claim 7 further including a light holding bracket for mounting said light, said light holding bracket being secured to said light support member.

10. The display unit according to claim 7 further including:

a light holding bracket for mounting said light on said light support member; and at least one strap mounted to said light support member for securing said light holding bracket thereto.

11. The display unit according to claim 7 further including:

a light holding bracket for mounting said light on said light support member; and at least one strap mounted to said light support member for securing said light holding bracket thereto, said at least one strap being adjustable to allow precise positioning of said light holding bracket along said light support member.

12. The display unit according to claim 7 further including:

a light holding bracket for mounting said light on said light support member;

at least one strap mounted to said light support member to secure said light holding bracket thereto, said at least one strap being adjustable to allow precise positioning of said light holding bracket along said light support member; and said light holding bracket having a long side having an inner and outer surface, said outer surface having an insulation attached thereon to reduce heat transfer from said light to said light support member.

13. A light fixture comprising:

a bracket comprising at least two opposing sides, and open in two directions opposite each other and orthogonal to said sides; and a light source positioned within said bracket to thereby provide substantially bi-directional light.

14. A light fixture comprising:

a light source, a bracket for holding said light source, said light source positioned within said bracket to thereby provide substantially bi-directional light, said bracket includes a long side having an inner and an outer surface and a short side having an inside and an outside surface; said outer surface and said inside surface having insulation attached there on to reduce heat transfer from said light; and said insulation on said inside surface having a reflective material placed thereon.

15. A light fixture comprising:

a light source;

a bracket for holding said light source, said light source positioned within said bracket to thereby provide substantially bi-directional light, said bracket has a long side having an inner and outer surface and a short side having an inside and an outside surface, said outer surface having an insulation attached thereon to reduce heat transfer from said light, said inner surface having an insulation place thereon to further reduce heat transfer, and said insulation on said inner surface has a reflective layer placed thereon.

16. A light fixture comprising:

a light source;

a bracket for holding said light source, said light source positioned within said bracket to thereby provide substantially bi-directional light, said light fixture used in conjunction with a light support member being spaced from a back surface to create an air gap there between, said bracket being attached to said light support member and positioned within said air-gap to thereby provide back lighting.

17. The light fixture according to claim 13 wherein said bracket is rectangular.

18. The light fixture according to claim 13 wherein said bracket is J-shaped.

19. The light fixture according to claim 13 wherein said bracket is U-shaped.

20. The light fixture according to claim 16 wherein said bracket is rectangular.

21. The light fixture according to claim 16 wherein said bracket is J-shaped.

22. The light fixture according to claim 16 wherein said bracket is U-shaped.

23. The light fixture according to claim 13 wherein said bracket is made of insulative material.

* * * * *